US005917533A

United States Patent [19]

Suzuki et al.

[11] Patent Number: 5,917,533

[45] Date of Patent: Jun. 29, 1999

[54] THERMAL LINE PRINTER

[75] Inventors: Minoru Suzuki; Hiroshi Orita; Michirou Ohishi; Kiyoshi Negishi; Katsumi Kawamura; Katsuyoshi Suzuki; Toshimasa Yamanaka; Jun Kitera; Mikio Horie, all of Tokyo, Japan

[73] Assignee: Asahi Kogaku Kogyo Kabushiki Kaisha, Tokyo, Japan

[21] Appl. No.: 08/767,801

[22] Filed: Dec. 17, 1996

Related U.S. Application Data

[62] Division of application No. 08/309,455, Sep. 22, 1994, Pat. No. 5,638,104.

[30] Foreign Application Priority Data

| | | | |
|---|---|---|---|
| Sep. 22, 1993 | [JP] | Japan | 5-236461 |
| Dec. 29, 1993 | [JP] | Japan | 5-350354 |
| Jun. 6, 1994 | [JP] | Japan | 6-123813 |

[51] Int. Cl.[6] ..... B41J 17/32; B41J 32/00

[52] U.S. Cl. ..... 347/214; 347/215

[58] Field of Search ..... 347/215, 214; 400/207, 208, 208.1, 234

[56] References Cited

U.S. PATENT DOCUMENTS

| | | | |
|---|---|---|---|
| 4,013,160 | 3/1977 | Colecchi et al. | 400/234 |
| 4,728,967 | 3/1988 | Tomita et al. . | |
| 4,778,290 | 10/1988 | Costa et al. . | |
| 4,860,029 | 8/1989 | Iseda . | |
| 4,869,606 | 9/1989 | Lehmann et al. . | |
| 4,910,602 | 3/1990 | Sakuragi | 347/215 |
| 5,023,628 | 6/1991 | Koch . | |
| 5,220,396 | 6/1993 | Monma et al. . | |
| 5,255,008 | 10/1993 | Yoshida . | |
| 5,289,244 | 2/1994 | Takano . | |

FOREIGN PATENT DOCUMENTS

| | | | |
|---|---|---|---|
| 0441038 | 8/1991 | European Pat. Off. . | |
| 0522903 | 6/1992 | European Pat. Off. . | |
| 0522903 | 1/1993 | European Pat. Off. | 400/208.1 |
| 5-38860 | 2/1993 | Japan | 400/207 |
| 2168930 | 7/1986 | United Kingdom . | |
| 2226794 | 7/1990 | United Kingdom . | |
| 2251217 | 7/1991 | United Kingdom . | |
| 2250478 | 6/1992 | United Kingdom . | |

OTHER PUBLICATIONS

United Kingdom Search Reports

*Primary Examiner*—Huan Tran
*Attorney, Agent, or Firm*—Greenblum & Bernstein, P.L.C.

[57] ABSTRACT

A cassette casing for holding an ink film ribbon has a discharge outlet for the ink film ribbon. A winding core is rotatably mounted in the cassette casing. An ink film ribbon is wound on the winding core and has one end thereof discharged through the discharge outlet. At least one slide contact member is disposed at the discharge outlet and contacts the ink film ribbon along the full width of the ink film ribbon.

19 Claims, 9 Drawing Sheets

FIG. 1
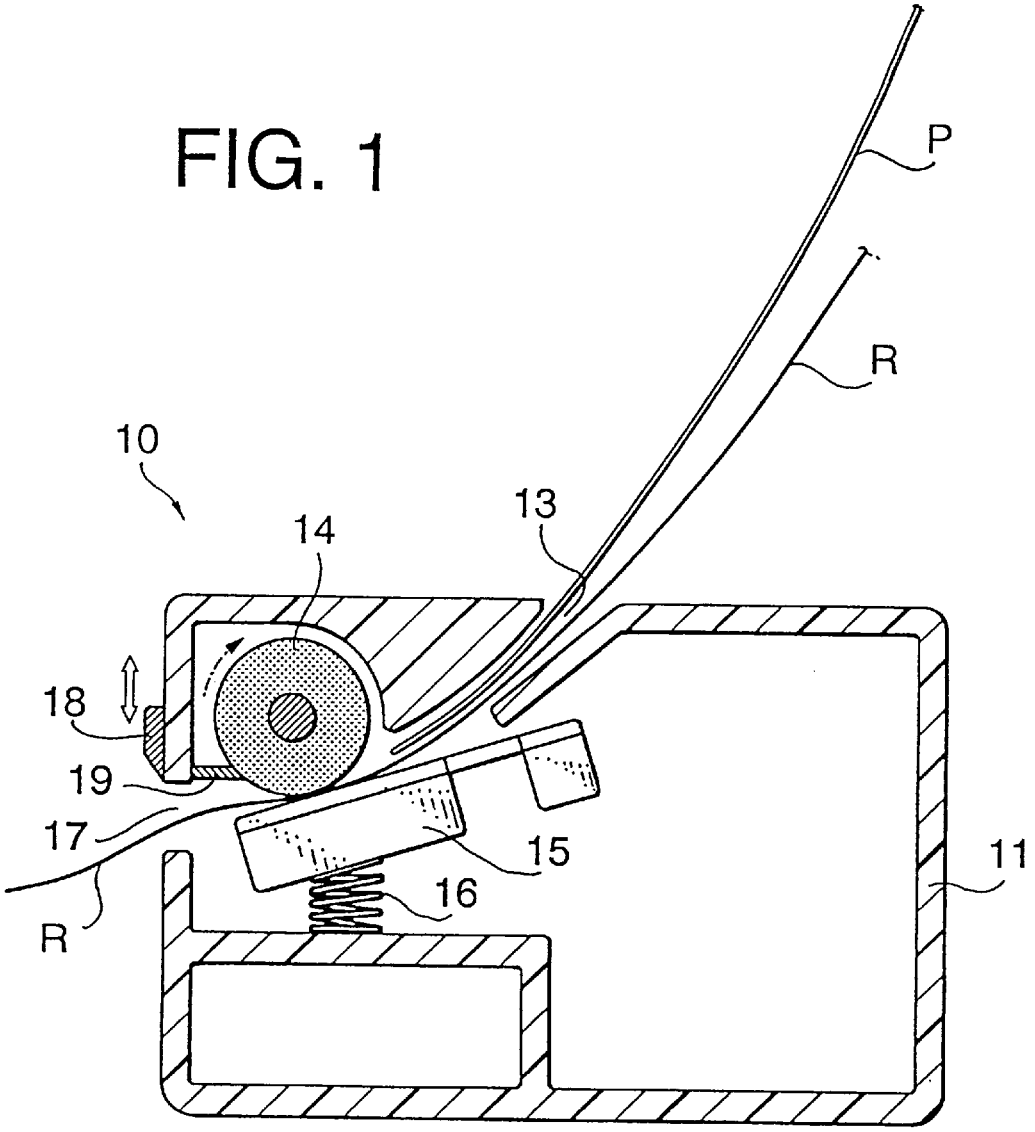
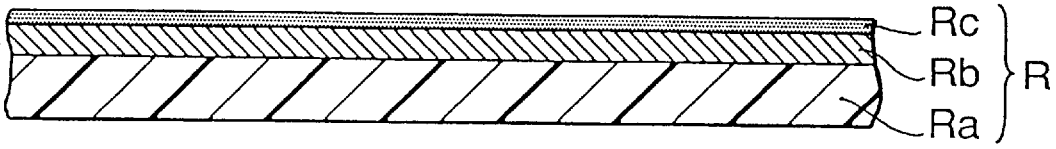
FIG. 2

FIG. 3
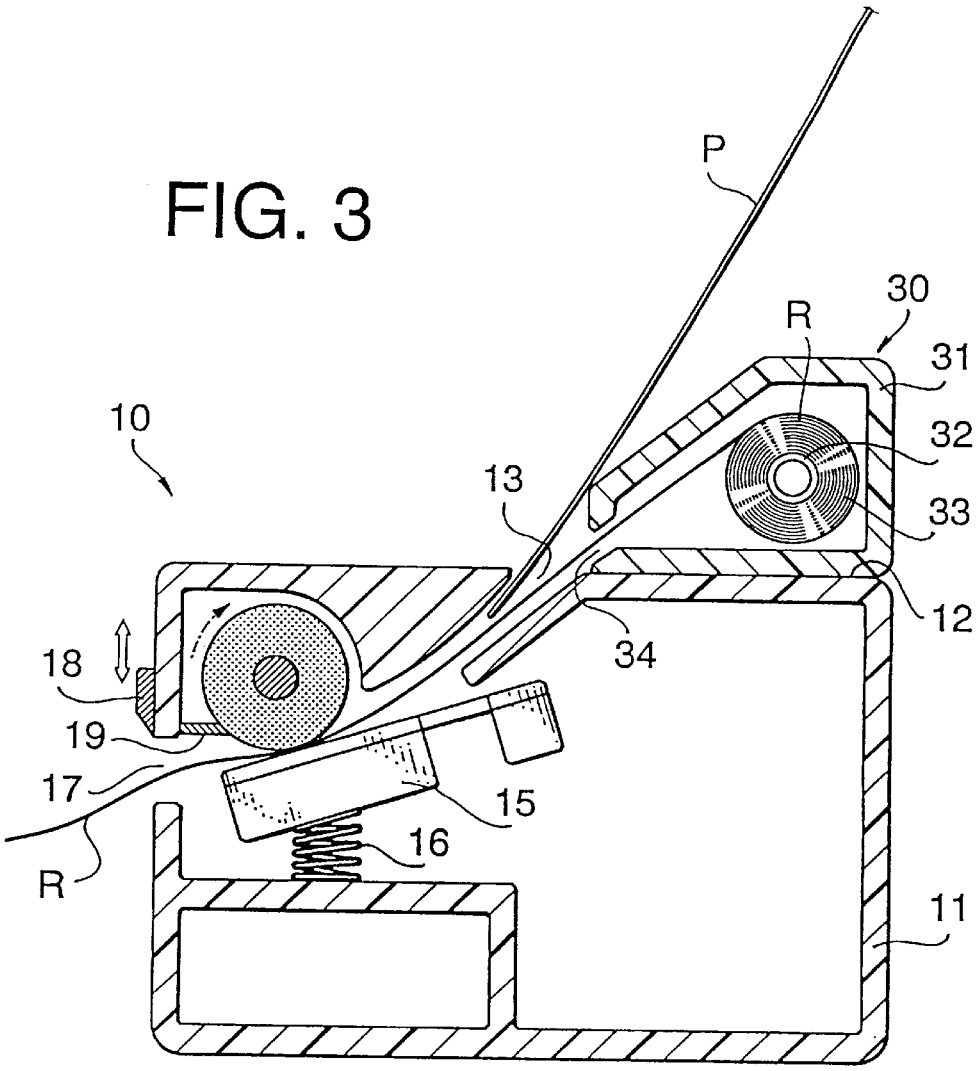
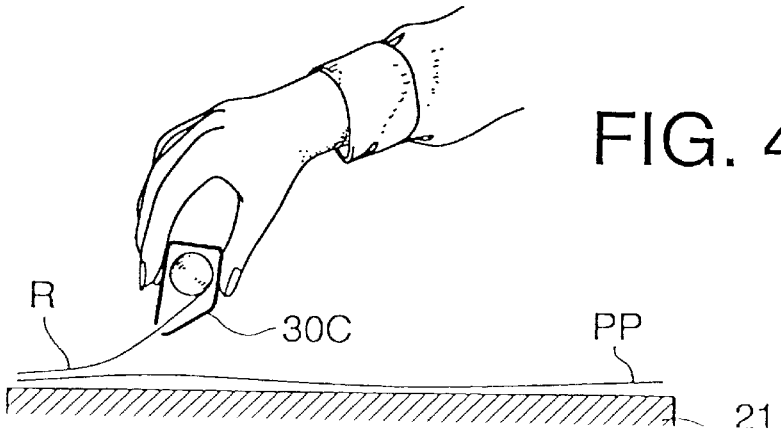
FIG. 4

THERMAL LINE PRINTER

This application is a division of application Ser. No. 08/309,455, filed Sep. 22, 1994, now U.S. Pat. No. 5,638, 104.

BACKGROUND OF THE INVENTION

The present invention relates to a thermal line printer that uses a thermal line print head to transfer character or image information to a sheet of paper.

Conventionally, a printer using a page-width line print head is able to print a full width of a page without mechanically moving the print head. Page-width line print heads are sometimes of the thermal type, which allow a quiet, inkless operation. However, conventional thermal ink print heads require prepared paper, usually thermo-sensitive paper, or two-ply paper having a peel-off transfer sheet bearing a thermo-sensitive substance. It is usually impossible to use untreated or ordinary paper in a thermal line printer.

If a printer, thermal or otherwise, has an inking ribbon enabling the use of untreated ordinary paper, then the inking ribbon is conventionally is stored in cassette or cartridge form. The ribbon cartridge typically has a supply side for unused ribbon, and a collection side to collect used ribbon. The necessity of achieving synchronization of the ink ribbon feed rate with the paper feed rate, while simultaneously ensuring proper feeding and collection, often results in a complicated feeding mechanism. Furthermore, the bulky ribbon cartridge is conventionally housed within the body of the printer, adding to the overall volume and weight of the printer along with the ribbon supply area, discharge area, feeding mechanism, and cassette housing.

SUMMARY OF THE INVENTION

It is therefore an object of the present invention to provide an improved line printer that is smaller and structurally simpler, and to allow the use of a quiet thermal ink print head with an ink film ribbon and ordinary untreated paper.

It is a further object of the present invention to provide an improved ink film ribbon cassette, capable of giving uniform back tension, smoothing wrinkles, and preventing ribbon slackness.

According to one aspect of the present invention, the improved line printer comprises a housing, a paper inlet in the housing, a mechanism for layering a page-width ink film ribbon and paper which are fed in the same direction and are introduced into the printer through the inlet. This aspect of the present invention further comprises a page-width line printing head which has printing elements uniformly arranged across substantially a full horizontal width of a printable page. The printing element transfer printing information equivalent to a full horizontal line of image data at a time to the layered one-sided ink film ribbon and paper as the layered one-sided ink film ribbon and paper is fed past the thermal line printing head. This aspect of the present invention further comprises a platen roller which opposes the thermal ink printing head and feeds the ribbon and paper past the printing head. The ink film ribbon is fed from a holder or cassette into the printer.

According to another aspect of the present invention, the improved thermal line printer comprises a housing, a paper inlet in an upper wall of the housing, and a platen roller for feeding the paper which is rotatably arranged along an interior corner formed by the upper wall and a side wall of the housing. This aspect of the present invention further comprises a page-width thermal line printing head, which has printing elements uniformly arranged across substantially a full horizontal width of a printable page. The printing elements transferring printing information equivalent to a full horizontal line of image data at a time to a printable page, and resiliently contacting the platen roller. This aspect of the present invention further comprises a motor arranged at one end of the platen roller, (which is associated with the platen roller), for rotating the platen roller to feed said paper, and a paper outlet located in the side wall of the housing for discharging a printed page from the printer. The ink film ribbon is fed from a holder or cassette into the printer.

Preferably, the printer further comprises a mechanism for layering ink film ribbon and paper, comprising a platen roller and a thermal line printing head. Alternatively, the mechanism for layering the ribbon and paper preferably comprises a plate spring and a layering roller. The mechanism for layering the ribbon and paper is optionally disposed in an ink film ribbon cartridge, usable with the thermal line printer.

Further preferably, the improved thermal line printer may use an ink film ribbon comprising a base layer, an ink film layer, and an adhesive agent layer. The adhesive agent layer may have a stronger adhesive force towards the center and a weaker adhesive force at the edges of the ink film ribbon.

Further preferably, the platen roller is formed with a greater diameter in the center along the axial direction, and with a lesser diameter at the ends. The platen roller may be provided with an anti-wrapping blade to prevent the severed ink film ribbon from wrapping around the platen roller.

Further preferably, the thermal line printing head is swingably supported about a pivoting axis, and is biased towards the platen roller by at least two symmetrically placed plate springs. In this case, each end of the pivoting axis is independently linearly movable within a limited range, in a direction substantially opposite to a direction of the bias applied by the plate springs.

Further preferably, the thermal line printing head and the platen roller may act to separate a plurality of sheets when a plurality of sheets is stacked and fed into the printer.

Preferably, the size and position of the electronic components on a circuit board in the improved thermal line printer are defined such that the components do not interfere with the thermal line printing head at any point in the possible range of movement of the thermal line printing head. Furthermore, the circuit board is cut, and printed circuits on said circuit board are arranged, to avoid at least one plate spring where a supporting portion of the plate spring intrudes into the usable circuit area.

According to another aspect of the present invention, an ink film ribbon cassette comprises a cassette casing for holding an ink film ribbon which has a discharge outlet. This aspect of the present invention further comprises a winding core which is rotatably mounted in the cassette casing and an ink film ribbon which is wound on the winding core, and has and one end discharged through the outlet. Optionally, the ink film ribbon cassette may have at least one slide contact member disposed at the discharge outlet, which contacts the ribbon along the full width of the ribbon. The slide control member may comprise a brush. Further optionally, the cassette may comprise a means for inducing back-tension on the ink film ribbon. Still further optionally, the cassette may comprise a mechanism for eliminating wrinkles on the film ribbon. Yet still further optionally, the cassette may comprise a mechanism for preventing slackening of the ink film ribbon.

According to yet still another aspect of the present invention, an ink film ribbon cassette comprises a cassette casing for holding an ink film ribbon and a winding core which core rotatably mounted in the cassette casing. The ink film ribbon is would on the winding core. This aspect of the present invention further comprises a paper entry slot for introducing paper into the cassette casing, a mechanism for layering the ribbon and paper introduced into the casing, and a discharge outlet for discharging the layered ribbon and paper. Optionally, the mechanism for layering the ribbon and paper comprises a plate spring and a layering roller.

According to another aspect of the present invention, an improved printing method comprises the steps of feeding a one-sided ink film ribbon from a roll towards and past a printing transfer channel and layering the ribbon and paper. The paper is fed in the same direction as the ribbon. Additionally, this aspect of the present invention further comprises transferring printing information equivalent to a line of a page to the layered ribbon and paper and a mechanism separating the layered ribbon and paper from one another.

DESCRIPTION OF THE ACCOMPANYING DRAWINGS

FIG. 1 is a schematic sectional view showing the fundamental elements of a basic thermal line printer embodying the present invention.

FIG. 2 is a sectional view showing an example of a composition of an ink film ribbon embodying the present invention.

FIG. 3 is a schematic sectional view showing a basic thermal line printer and ink film ribbon cassette embodying the present invention.

FIG. 4 shows a method of using an ink film ribbon cassette embodying the present invention.

DESCRIPTION OF THE EMBODIMENTS

Figure 5:
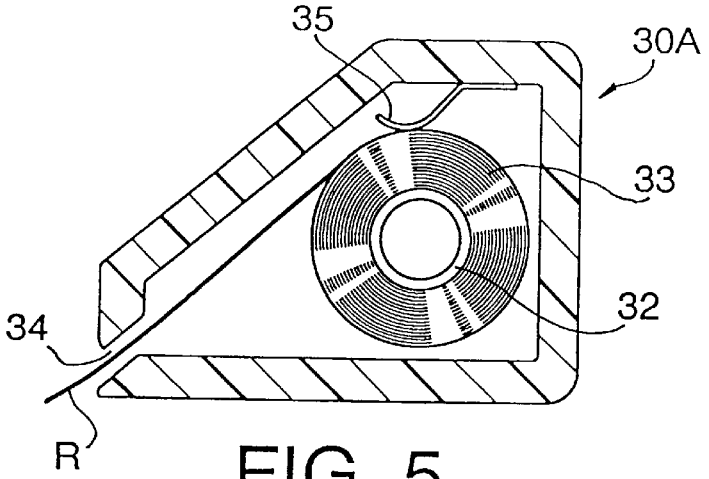
FIG. 5 is a sectional view of a first embodiment of an ink film ribbon cassette of the present invention.

With reference to the drawings, a basic embodiment of the present invention is first described.

As shown in FIG. 1, a thermal line printer 10 embodying the present invention is provided with a housing 11. In the top surface of the housing 11, an inlet slot 13 is formed, into which both paper P (which can be, e.g., plain/normal, untreated paper) and ink film ribbon R are inserted. The platen roller 14 and the thermal line head 15 are disposed inside the housing 11, directly downstream of the paper inlet 13, such that the interface between the platen roller 14 and line head 15 may receive the paper P as it is guided into the housing 11 by via the inlet slot 13. The thermal line head 15 comprises an array of heat generating elements, the array having a length substantially equivalent to the width of a single page, and arrayed in the axial direction of the platen roller 14. The thermal line head 15 is thereby able to print information on the paper P, equivalent to a full line of page, without any movement of the thermal line head 15. The thermal line head 15 is pressed against the platen roller by a biasing means, for example, as a compression spring 16. A transfer channel is thereby formed between the platen roller 14 and the thermal line head 15.

As seen in FIG. 3, an ink ribbon cassette 30 is preferably mounted to the printer housing 11 by means of a cassette mount 12, e.g., a bayonet or snap mount, or other known mounting structure (not shown). The ink ribbon cassette 30 comprises an ink film outlet slot 34 through which the ink film ribbon R is fed into the printer housing 11. When the ink film cassette 30 is properly mounted, the ink film outlet slot 34 of the cassette 30 is arranged to feed the ink film ribbon R directly into the inlet slot 13 of the printer housing 11.

FIG. 2 shows the structure of an ink film ribbon R to be used with the thermal line printer of the present invention. The structure of the ink film ribbon Ra ensures evenly distributed and constant contact with the paper P by adhering the ink film ribbon R to the paper P.

As shown in FIG. 2, the ink film ribbon R is a lamination composed of a base material Ra (made of a synthetic resin), an ink film Rb, and an adhesive agent Rc. The adhesive agent Rc is used to ensure that the ink film ribbon R contacts the paper P in a satisfactory manner by adhering the ribbon R to the paper P, and to ensure that the contact is maintained without slipping during the entire print operation. Alternatively, the ink film ribbon R is a lamination of only a base material R and an ink film Rb, wherein another method is used to ensure satisfactory contact. Satisfactory contact may be alternatively ensured by direct friction resistance between the paper P and ink film ribbon. This may be achieved via attraction resulting from static electricity and air or vice viscosity generated by slightly melting the ink film Rb in contact with the paper P. The ink film ribbon R can be comprised of known materials, with both the base layer and the ink film layer being similar to those used in known "peel-off" paper ribbons.

If an adhesive agent layer Rc is used in the ink film ribbon R lamination, it is preferable to have the adhesive force stronger at the central portion along the width and weaker at the peripheral portions. If the adhesive force is stronger in the central portion, the paper P and ink film ribbon R will resist relative skew when adhered. The adhesive force of the adhesive agent layer Rc is chosen such that the paper P and ink film ribbon R are easy to separate from each other when printing is complete. The adhesive layer, when used, is selected from known adhesives which are suitable for rolling the ink film in a roll and feeding it through a printer.

As described, the ink film ribbon R adheres to the paper by means of the adhesive agent Rc, and is therefore fixed to the paper P for the entire duration of a print operation.

Proper contact, alignment, and ink transfer are thereby ensured. The ink film ribbon R is further improved by making the adhesive agent Rc stronger in the center of the ribbon R, improving the resistance to skew and allowing easy separation of the ribbon R and paper P.

FIG. 5 shows a first embodiment of an ink film ribbon cassette 30A. In the first embodiment of an ink film ribbon cassette 30A, the cassette 30A contains an ink film ribbon R wound about a winding core 32. As shown in FIG. 5, one end of a plate spring 35 presses the ink film ribbon R onto the winding core 32, and the other end is supported by the cassette case 31. The plate spring 35 prevents the ink film ribbon R from unwinding in the storage state, and maintains tension on the ink film ribbon R as the ribbon is pulled out. The preferred construction provides plate springs 35 at the central portion (along the width of the ink film ribbon R) to prevent skewing of the ink film ribbon R. Furthermore, tension is given to the ink film ribbon R by providing a means of resistance, frictional or otherwise, at the bearing of the winding core 32, or by providing a torsion spring at the axis of the winding core 32. When the cassette 30A is properly mounted, the ink film ribbon R is pulled from the ink film ribbon outlet 34, which unwinds the core 32. The ink film ribbon R may then be inserted into the inlet slot 13 of the printer housing 11.

As described, the first embodiment of an ink film ribbon cassette 30A prevents the ribbon R from unwinding when stored, and maintains tension on the ribbon R as the ribbon is pulled out of the cassette 30A. Thus, the first embodiment of an ink film ribbon cassette 30A ensures that the ribbon R may always be maintained in a state favorable to enter the printing region.

Figure 6:
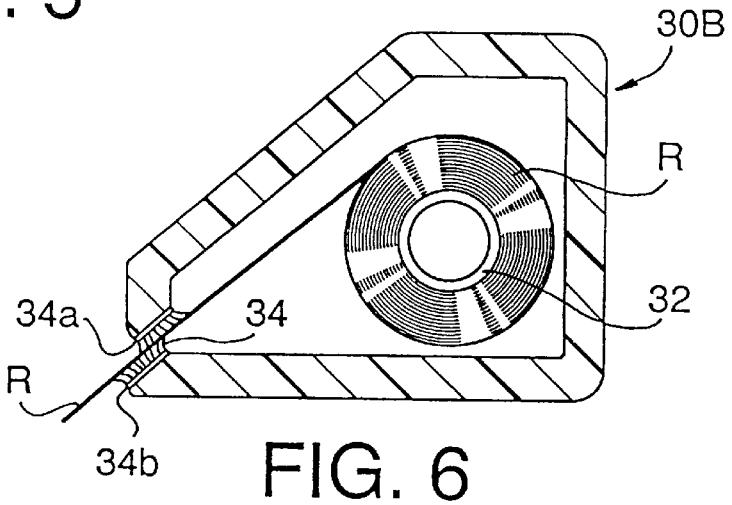
FIG. 6 is a sectional view of a second embodiment of an ink film ribbon cassette of the present invention.

FIG. 6 shows a second embodiment of an ink film ribbon cassette 30B. The second embodiment of an ink film ribbon cassette 30B is also able to resist unwinding and to maintain ribbon tension. The second embodiment differs from the first in that the tensioning means also provides a ribbon smoothing function.

The second embodiment of the cassette 30B is similarly formed to the fist with a winding core 32 and ribbon outlet 34. However, at the ribbon outlet 34, slide contact members 34*a*, 34*b* are disposed such that the ink film ribbon R will pass between, and contact, both of the slide contact members 34*a*, 34*b*, across the entire width of the ink film ribbon R. In the preferred embodiment, the sliding contact members comprise a pair of brushes. The sliding contact members 34*a*, 34*b* prevent the ink film ribbon R from unwinding in the storage state. Furthermore, the sliding contact members 34*a*, 34*b* are able to maintain back tension on the ink film ribbon R as the ribbon is pulled out. The sliding contact members 34*a*, 34*b* are further able to provide a ribbon smoothing function as the ink film ribbon R is pulled out between them. As in the first embodiment of a cassette, when the cassette 30B is properly mounted, the film ribbon R is pulled from the ink film ribbon outlet 34 and inserted into the inlet slot 13.

The second preferred embodiment of an ink film ribbon cassette 30B is described herein as having a pair of brushes as the sliding contact members 34*a*, 34*b*. However, the sliding contact members may be of any construction that achieves the three described functions. Furthermore, a brush or a sliding contact member may be disposed on only one side of the ribbon outlet 34.

As described, the second embodiment of an ink film ribbon cassette 30B prevents the ribbon R from unwinding when stored, maintains tension on the ribbon R as the ribbon is pulled out of the cassette 30A, and further provides a ribbon smoothing function as the ink film ribbon R is pulled out. Thus, the second embodiment of an ink film ribbon cassette 30A ensures that the ribbon R may always be maintained in a state favorable to enter the printing region, and that the ink film ribbon R contacts the paper P without wrinkling.

In the above described first and second preferred embodiments of an ink film ribbon cassette 30A and 30B, the description is directed at an ink film ribbon for a thermal line printer. However, the invention is similarly applicable to an ink ribbon cassette for a dot matrix printer.

Figure 7:
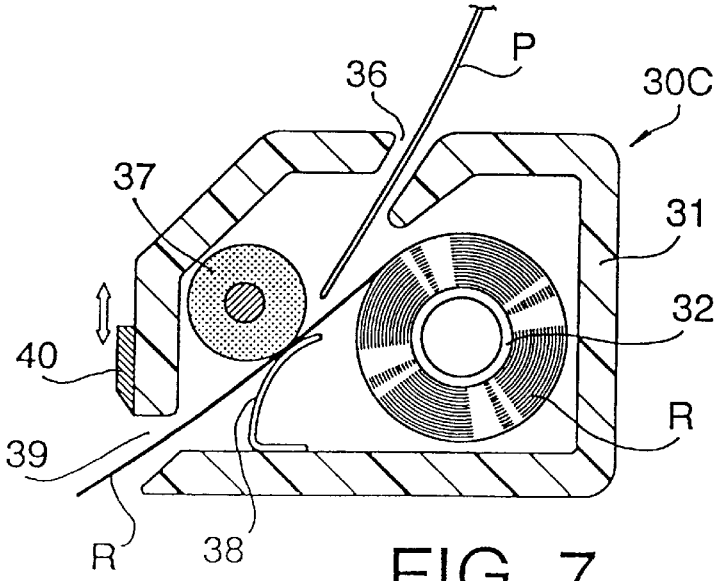
FIG. 7 is a sectional view of a third embodiment of an ink film ribbon cassette of the present invention.

FIG. 7 shows a third embodiment of an ink film ribbon cassette 30C of the present invention. In the third embodiment of an ink film ribbon cassette 30C, the cassette is able to both prevent the ribbon R from unwinding when stored, and to maintain tension on the ribbon R as the ribbon is pulled out. Furthermore, the third embodiment of an ink film ribbon cassette 30C is designed so that the ink film ribbon R and paper P are layered before entering the transfer channel between the platen roller 14 and the thermal line head 15.

The ink film ribbon cassette 30C comprises a mechanism to layer the paper P and ink film ribbon R, and a cutter 40. A cassette paper inlet 36 is located in the cassette case 31, and a layering roller 37 and plate spring 38 are provided directly downstream of the cassette paper inlet 36. The plate spring 38 resiliently contacts the layering roller 37 as the ink film ribbon R is passed between the roller 37 and the plate spring 38. Paper P inserted through cassette paper inlet 36 is layered with the ink film ribbon R by the roller 37 and the plate spring 38. A cutter 40 is secured at the cassette outlet 39, which may cut off either the ink film ribbon R or both the layered paper R and ink film ribbon R. In contrast to the first and second embodiments of an ink film ribbon cassette, when the cassette 30C is properly mounted the layered ink film ribbon R and paper P are pulled together from the cassette outlet 34 and inserted into the inlet slot 13.

Alternatively, if the ink film ribbon cassette R is installed in the printer housing 11, it is possible to manufacture a very simple thermal line printer.

Further, using the ink film ribbon cassette 30C of the third embodiment, the ink film ribbon R is severed before printing with the thermal line head 15, and during the printing process. Specifically, the time of severing of the ink film ribbon R is set according to the paper transfer distance from the ink film ribbon R to the interface between the platen roller 14 and the thermal line head 15.

If an adhesive-bearing ink film ribbon R is used, the ink film ribbon cassette 30C becomes a peel-off paper producing device. The ink film ribbon R and paper P are simultaneously severed by the cutter 40. Simultaneously severing the paper P and ribbon R is particularly useful when non-standard sizes or shapes of paper are used. As shown in FIG. 7, when an adhesive-bearing ribbon R is used, the ink ribbon cassette 30C can be removed from the printer housing 11, and used to adhere the ink film ribbon R to a paper sheet P of non-standard size or shape placed on a plane surface 21. A peel-off sheet bearing the non-standard paper P is thereby created, and is inserted directly into the printer 10.

As described, in the third embodiment of the ink film ribbon cassette 30C, the paper P is layered with the ink film ribbon R before they are inserted into the paper inlet 13 of the printer housing 11, thus ensuring simplified and reliable printing. Furthermore, the ink film ribbon cassette 30C is able to prevent the ribbon R from unwinding when stored, and maintain tension on the ribbon R as the ribbon is pulled out, ensuring that the ribbon R and paper P enter the printing region in a favorable state. Further, the ink film ribbon cassette 30C may be used as a device to create non-standard sizes or shapes of peel-off paper, which is fed normally through the printer.

The platen roller 14 is shown in FIG. 1. The platen roller is preferably formed in a shape that ensures that neither the paper P nor the ink film ribbon R become skewed during printing.

the preferred shape of the platen roller 14 is a barrel shape (not shown); that is, of slightly greater diameter in the center and slightly lesser diameter at the ends, along the axial direction of the platen roller 14. The barrel shape is an additional inventive countermeasure against relative skew of the paper P and ink ribbon R. The combination of an adhesive layer stronger in the center of the ink film ribbon R, as described, and a barrel-shaped platen roller 14 is particularly effective in preventing relative skew of the paper P and the ink film ribbon R. Skewing may also be prevented by reversing the platen roller 14 slightly when inserting the paper P, followed by normal forward feed rotation.

As described, the platen roller 14 is formed in a barrel shape. Thus, the platen roller 14 may improve paper handling by resisting relative skew of the paper P and the ink ribbon R as the printing is performed.

A discharge slot 17, through which printed paper P and used ink film ribbon R are discharged from the printer, is disposed on the side of the printer housing 11, downstream of the transfer channel formed by the platen roller 14 and the thermal line head 15. A cutter 18 is arranged near the discharge slot 17. The cutter 18 is fixed in position, or formed unitarily with some portion of the housing 11, so that used ink film ribbon R or paper P are lifted against the cutter 18 and thereby separated. Alternatively, as shown by the arrows in FIGS. 1 and 3, the cutter 18 may be movable in the direction opening and closing of the discharge slot 17 (e.g., cutter 18 can be slidably positioned on rails or guides, not shown, which are attached to the front surface of housing 11), and the used ink film ribbon R or paper P is cut off when the cutter 18 is moved across the discharge slot 17. Also, a discharge bin (not shown) may be used to continuously collect used ink film ribbon, instead of the cutter 18.

Although the cutter shown in FIGS. 1 and 3 moves only up and down, a rotary cutter may be used, or separation perforations or breaking lines may be added to the ink film ribbon R at a predetermined spacing. Furthermore, the ink film ribbon R may be severed with heat generated by the thermal line head or by a heating element.

In the printer housing 11, an anti-wrapping blade 19 is positioned and aligned between the platen roller and the discharge slot 17, to prevent the severed ink film ribbon R from wrapping around the platen roller 14. When the leading edge of the severed ink ribbon is pulled towards the cutter, and severed, the ribbon tends to be drawn towards, and/or adhere to, the anti-wrapping blade 19. The blade 19 is shown as positioned generally horizontally, but it can also be inclined with respect to the housing.

The thermal line printer 10 as described above, may use the ink film ribbon R, fed from the ink ribbon cartridge 30A, 30B, or 30C, to print on ordinary untreated paper P. The ink film ribbon R is fed from the ink film cassette 30, and is inserted together with the paper P into the inlet slot 13 and acts thereafter to the transfer interface between the platen roller 14 and the thermal line head 15. The platen roller 14 is then rotated in a forward feed direction (clockwise as shown in FIG. 1), causing the paper P and ink film ribbon R to enter the transfer interface and thereby adhere to each other by one of the methods described previously. In the adhered state, the ink film layer Rb of the ink film ribbon R is selectively melted by the thermal line head 15 in accordance with printing information. The resulting pattern is transferred to the paper P as the platen roller 14 is driven in the forward feed direction. The actions of (1) layering and adhering the paper P and the ink film ribbon R and (2) thermal transfer of printing information to the paper P are simultaneously performed.

When the third embodiment of an ink film cassette 30C is used, the actions of (1) layering and adhering the paper P and the ink film ribbon R and (2) thermal transfer of printing information to the paper P are separately performed. As a sheet of paper P is inserted through the cassette paper inlet 36, it is brought into contact with the paper P and is thereby layered. The layered paper P and ink film ribbon R are then fed into the inlet slot 13, and enter the interface between the platen roller 14 and the thermal line head 15 together. The platen roller 14 is then rotated and the layered paper P and ribbon R are advance into the printing region, thus simplifying printing.

For any described embodiment of ink film cassette, the printed paper P and used ink film ribbon R are then delivered through the discharge slot 17. The platen roller stops rotating after a number of revolutions corresponding to the lengthwise size of the paper P. Thereafter, it is possible to separate the paper P from the ink film ribbon R and remove the paper P. The ink film ribbon P may then be severed by the cutter 18. The leading edge of the paper P is prevented from wrapping around the platen roller 14 by the anti-wrapping blade 19, and is also drawn towards the anti-wrapping blade 19. The cutting position of the ink film ribbon R may then be used as the reference position for initially setting the ink film ribbon R. Subsequently, continuous printing is possible to sequentially inserting the paper P into the inlet slot 13, or into the paper inlet 36 of the third described embodiment of an ink film ribbon cassette 30C.

The control of the thermal line head 15 is not described as it is not related to the features of the invention. However, information such as paper size is given to the control device (not shown) of the thermal line head 15.

Figure 8:
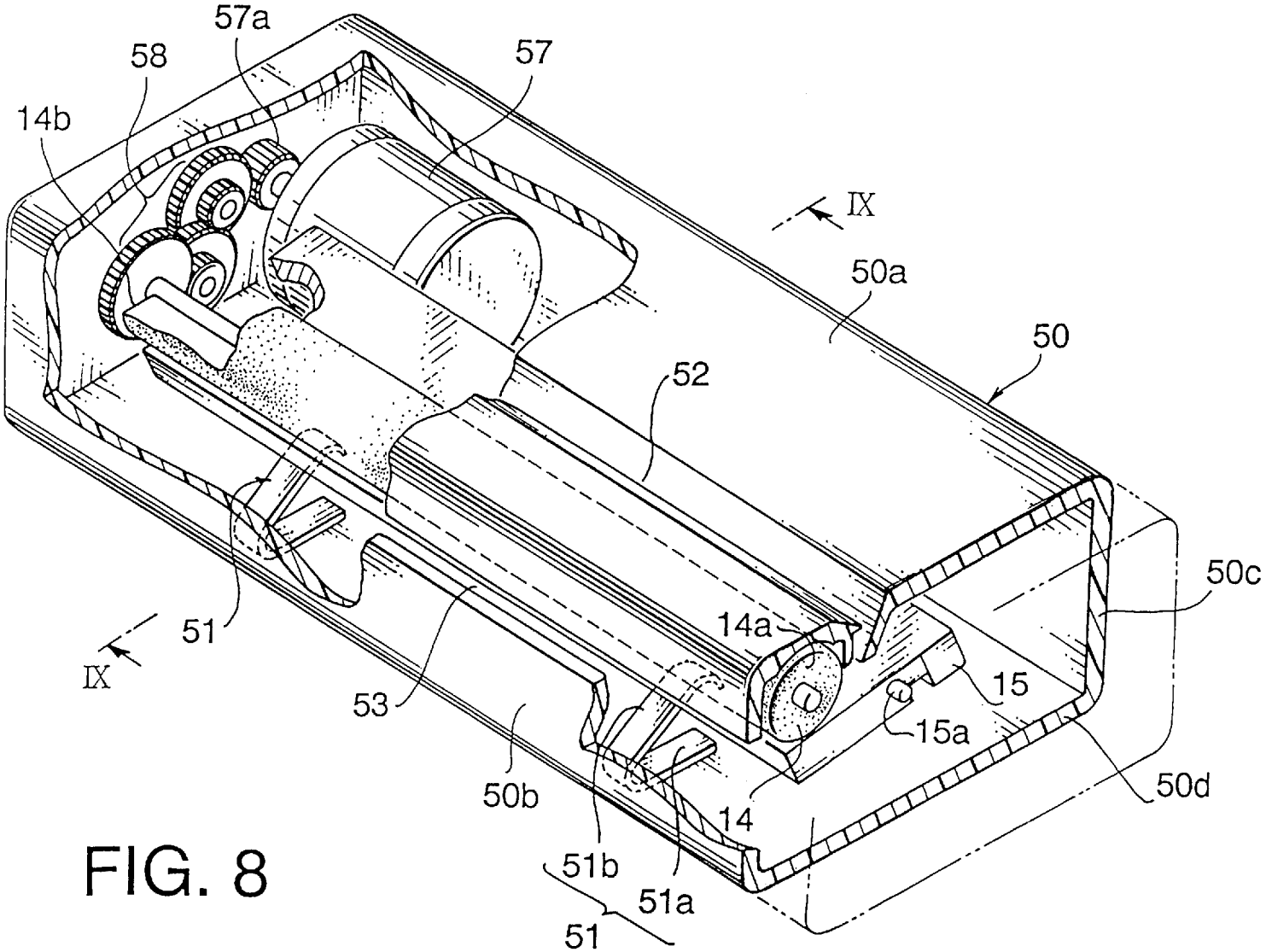
FIG. 8 is a partially sectioned perspective view of a thermal line printer embodying the present invention.

FIG. 8 shows a second embodiment of a thermal line printer according to the invention. The second embodiment is preferably used with either (a) conventional thermal paper, or (b) the layered paper P and ink film ribbon R. In this embodiment, the housing 50 is a roughly rectangular parallel-piped structure having a longer width than the width of printing paper P (for example, A4 size plain paper). The housing is defined by upper wall 50*a*, front wall 50*b*, rear wall 50*c*, bottom wall 50*d*, and end walls 50*e*, 50*f*. Front and rear upper interior corner volumes are defined in the housing 50 interior at the junction of upper wall 50*a* and front wall 50*b*, and at the junction of upper wall 50*a* and rear wall 50*c*. The platen roller 14 is disposed along the front upper interior corner volume defined by the junction of upper wall 50*a* and front wall 50*b*. The thermal line head 15 is swingably supported by pivot pins 15*a* below the pivot roller 14. A pair of plate springs 51, 51 are provided below the swingable thermal line head 15. The plate springs 51, 51, supported by the bottom wall 50*d* of the housing 50, bias the swingable thermal line head 15 towards the platen roller 14. The pair of plate springs 51, 51 are symmetrically positioned in either lateral side of the thermal line head 15, and are substantially v-shaped, having a support leg 51*a* fixed on the bottom wall

50*d* of the housing 50 and a resilient leg 51*b* contacting the underside of the thermal line head 15. The thermal line head 15 contacts the platen roller 14, biased by the two resilient legs 51*b*, 51*b* of the pair of plate springs 51, 51.

A paper insertion slot 52, longer than the width of a typical paper sheet, is formed in the upper wall 50*a* of the housing 50, directly upstream of the platen roller 14. A paper discharge slot 53 is formed in the front wall 50*b*, directly downstream of the platen roller 14. The paper insertion slot 52 is formed with a lower guide surface 52*a* and an upper guide surface 52*b*, which guide either (a) conventional thermal paper or (b) both the paper P and the ink film ribbon R to the transfer channel between the platen roller 14 and the thermal line head 5. A paper detecting sensor 54 is disposed along the paper path directly upstream of the platen roller 14. The paper detecting sensor 54 may comprise, for example, a reflection-type photo-interruptor.

Figure 9:
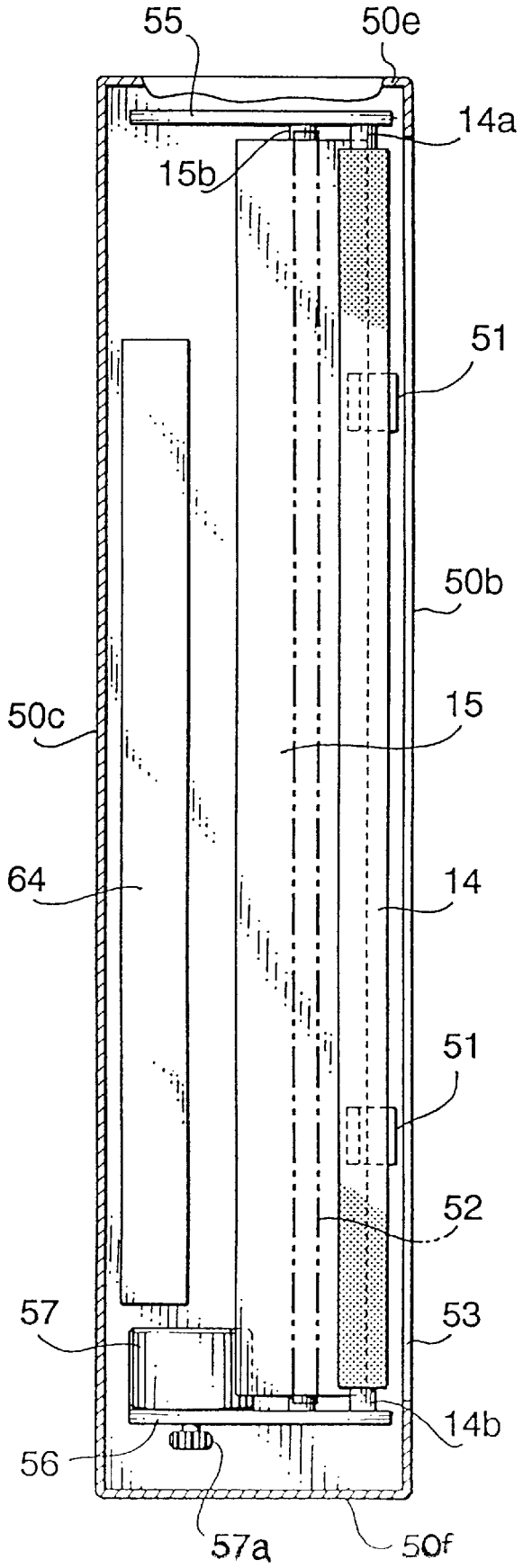
FIG. 9 is a plan view of a thermal line printer embodying the present invention.
Figure 10:
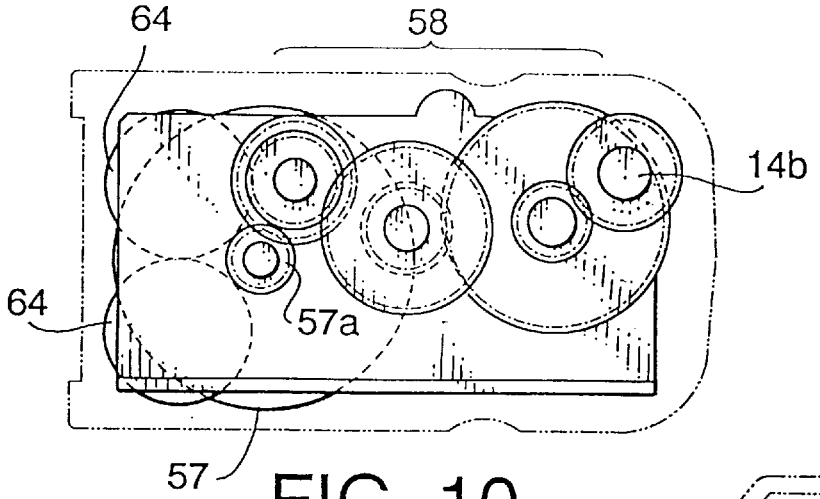
FIG. 10 is a side view showing a drive system of a thermal line printer embodying the present invention.

As shown in FIG. 9, supporting frames 55 and 56 are disposed adjacent the internal surface of end walls 50*e* and 50*f* respectively. The supporting frames 55 and 56 support both the platen roller 14 and the thermal line head 15 at either end of the housing 50. A drive motor 57 having a drive pinion 57*a* is fixed to the one of the supporting frames 55. The drive pinion 57*a* is coupled via a gear train 58 to a driven gear 14*b* provided to the axis of the platen roller 14. The drive motor 57 may thereby drive the platen roller via the gear train 58. Such that layered paper P and ink film ribbon R are platen-fed at a predetermined rate between the platen roller 14 and the thermal line head 15, and discharged through discharge slot 53.

Figure 14:
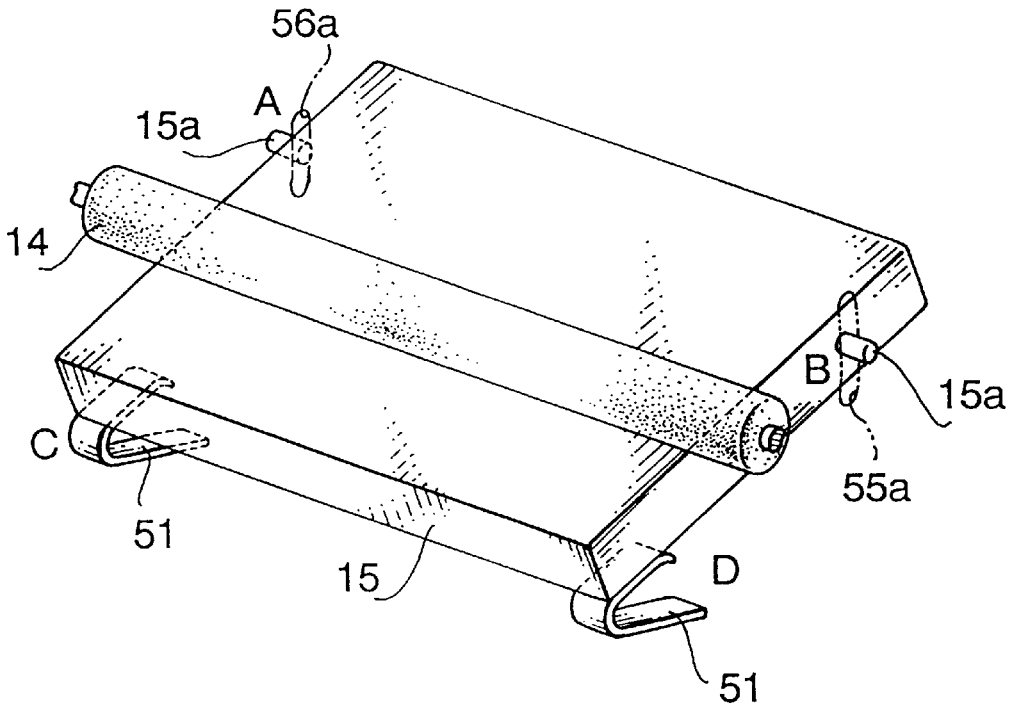
FIG. 14 is a schematic perspective view illustrating a supporting structure for a thermal line head embodying the present invention.
Figure 15:
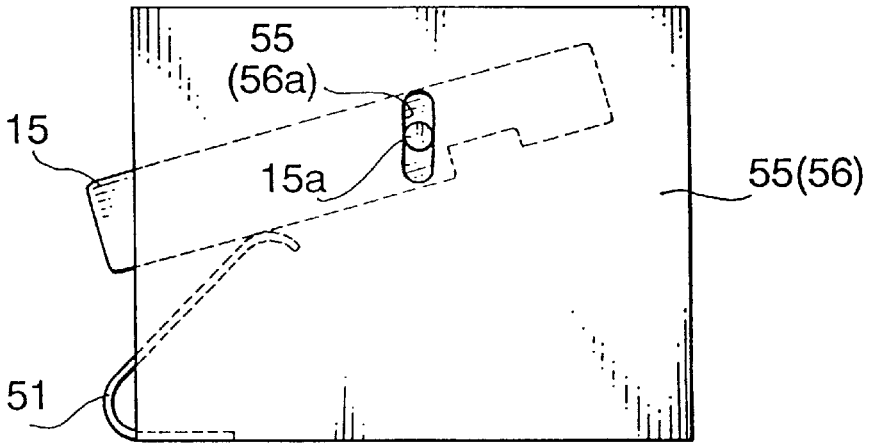
FIG. 15 is a schematic side view illustrating a supporting structure for a thermal line head embodying the present invention.

FIGS. 14 and 15 shown an improved structure for supporting the pivot pins 15*a* of the thermal line head 15. The improved structure allows laterally balanced and constant contact of the thermal line head 15 with the platen roller 14.

Referring to FIG. 14, if the pivot pins 15*a* are rigidly (rotatably) supported, the portions of the thermal line head 15 labeled C and D in FIG. 14 will not maintain laterally balanced contact with the platen roller 14 unless the pivoting axis of pivot pins 15*a*, 15*a* is perfectly parallel with the axis of the platen roller. Laterally balanced contact of the thermal print head 15 to the platen roller 14 is necessary to ensure an even printing distribution across the width of a page. Substantially vertical guide slots 55*a* and 56*a* are formed in the support frames 55 and 56, respectively. The pivot pins 15*a*, 15*a* are fitted in the guide slots 55*a* and 56*b*, and the thermal line head 15 may pivot abut the axis of the pivot pins 15*a*, 15*a*. Each pivot pin 15*a*, 15*a* may independently move slightly up and down in the guide slots 55*a* and 56*b*. While the plate springs 51, 51 push the thermal line head 15 against the platen roller 14 with approximately equal force for each plate spring 51, 51, the pivot-pins may self-align. Therefore, an even distribution of force across the thermal line head 15 is ensured, as the portions of the thermal line head at C and D are biased to contact the platen roller 14, the pivot pins 15*a*, 15*b* may each move independently up and down.

As described, the pivot pins 15*a* of the thermal line head 15 are supported to be both swingable and independently vertically movable in a small range. Thus, the thermal line head 15 is supported in a manner that ensures constant and laterally balanced contact with the platen roller 14.

Figure 12:
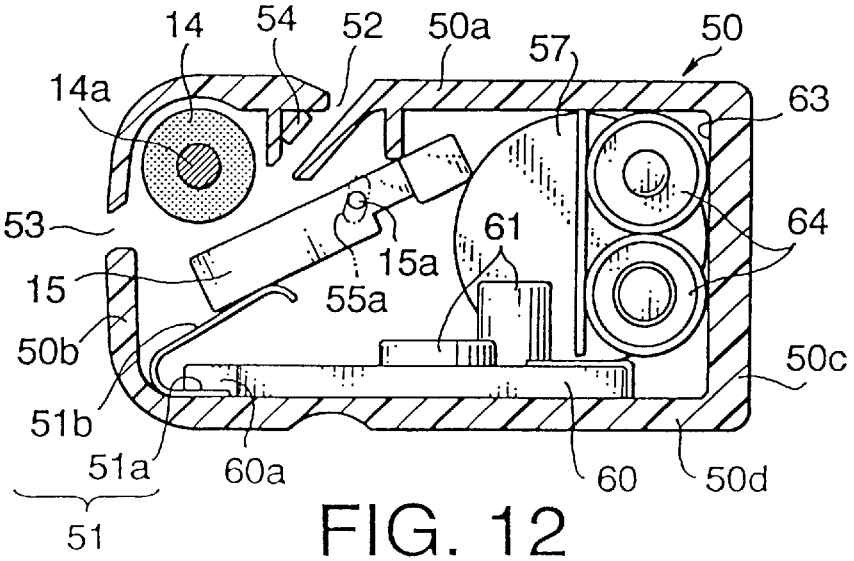
FIG. 12 is a cross-sectional view taken along the datum IX—IX of FIG. 8, showing the relationship of a printed circuit board and electronic components to a second state of a thermal line head embodying the present invention.
Figure 13:
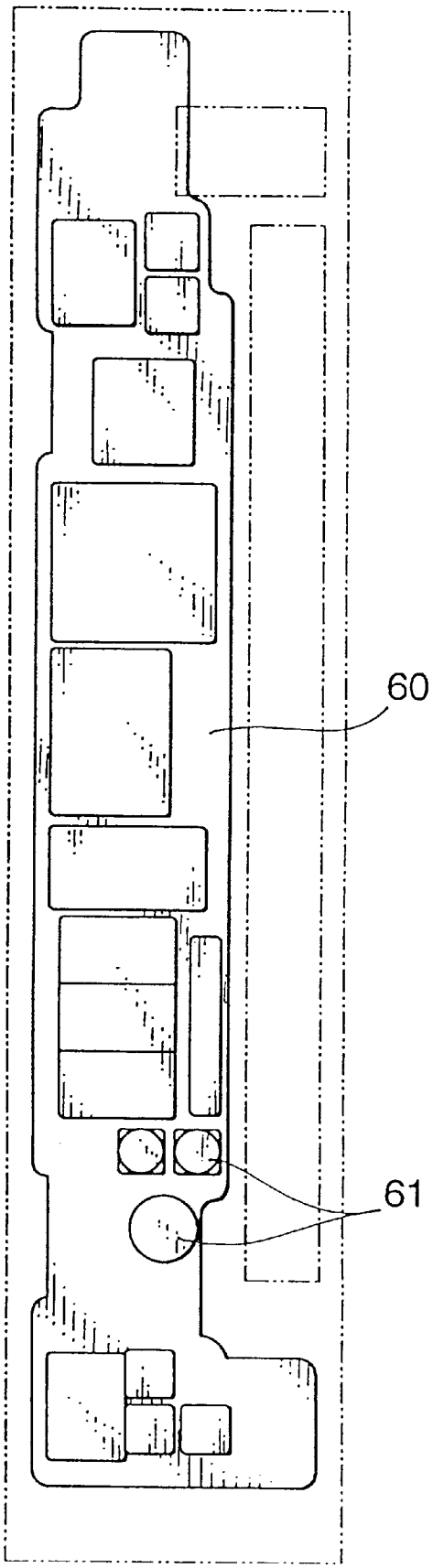
FIG. 13 is a plan view of a printed circuit board embodying the present invention.

FIGS. 12 and 13 show an improved arrangement for a control circuit board 60. The improved arrangement optimizes the use of area and volume around the circuit board 60 so that the overall size of the printer is smaller.

As shown in FIG. 13, a printed circuit board 60, bearing electronic components 61 for controlling the operation of the printer, is arranged along the bottom wall 50*d* of the housing 50. The shape of the printed circuit board 60 has a cutaway 60*a* in the region of the plate springs 51, 51 to maximize the available surface area of the circuit board 60. Furthermore, the electronic components of the circuit board are conventionally positioned and sized according only to the constraints of rational circuit design. Of if positioned in a confined space such as the confined space shown in FIG. 12, then the components and circuit board typically define a space into which moving mechanical parts may not intrude. However, the size and position of the electronic components on the circuit board 60 in the improved arrangement are defined such that the components 61 do not interfere with the thermal line head at any point in the possible range of movement of the thermal line head. Specifically, components 61 having a greater bulk are disposed on the circuit board 60 towards the rear wall 50*c* of the housing 50, so that the thermal line head 15 will have a greater range of movement above that part of the circuit board 60 that is towards the front wall 50*b*. Space freed by optimizing the circuit board 60 structure is used to make the printer more compact.

As described, both the area and the volume occupied by the control circuit board 60 are defined such that the mechanical components of the printer may intrude into what would normally be space reserved for printed circuits and electronic components. Thus, the overall size of the printer is made smaller through more efficient use of available space.

An installation area 12 for the ink ribbon cassette 30 is preferably located adjacent to the paper inlet slot 52, on the top of the upper wall 50*a* of the housing 50. Cassette 30 is attached to housing 50 in a manner substantially as described above with respect to the cassette(s) and housing of FIGS. 1–6. As shown in FIG. 12, a battery chamber 63 is formed at the rear wall 50*c* of the housing 50*c*. The battery chamber 63 is positioned in the same plane along the rear wall 50*c* as the drive motor 57, but at a different location along the rear wall 50*c*. Therefore, batteries 64, accommodated in two upper and lower stages, and the drive motor 57 may all be located along the rear wall 50*c*.

It is possible to construct a smaller housing 50 and printer by virtue of the described arrangement of platen roller 14, thermal line head 15, drive motor 57, control printed circuit board 60, electronic components 61 and battery chamber 63.

Figure 11:
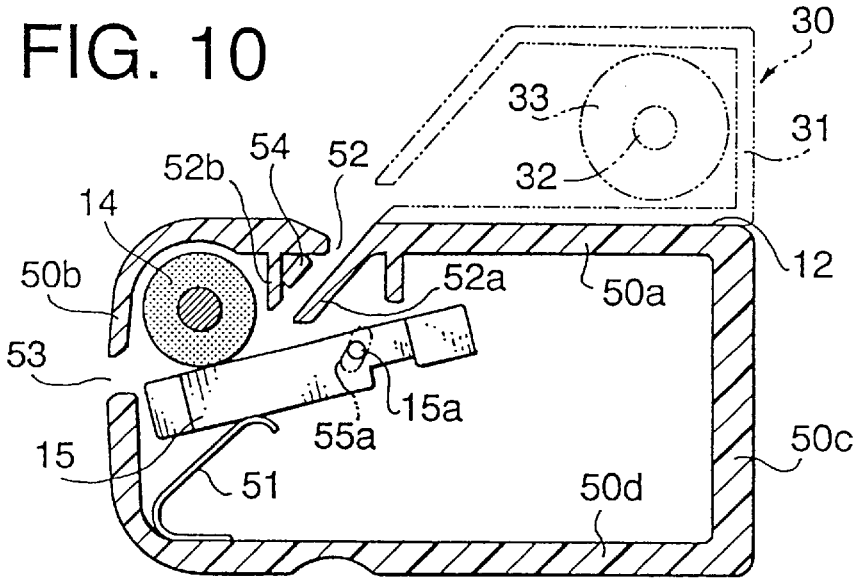
FIG. 11 is a cross-sectional view taken along the datum IX—IX of FIG. 8, showing a first state of a thermal line head embodying the present invention.

In a manner similar to the basic printer as described in FIGS. 1 and 3, the thermal line printer of FIGS. 8 through 15 is used by inserting either (a) conventional thermosensitive paper or peel-off paper or (b) both the paper P and ink film ribbon R through the paper inlet slot 52, feeding the paper or layered paper-ribbon with the platen roller 14, and giving printing information to the thermal line head 15 in synchronization with the feed. As shown in FIGS. 11 and 12, it is easy to perform maintenance in the platen/head area by pressing the thermal line head 15 against the resistance of plate springs 51, 51 and away from the platen roller 14.

Figure 16:
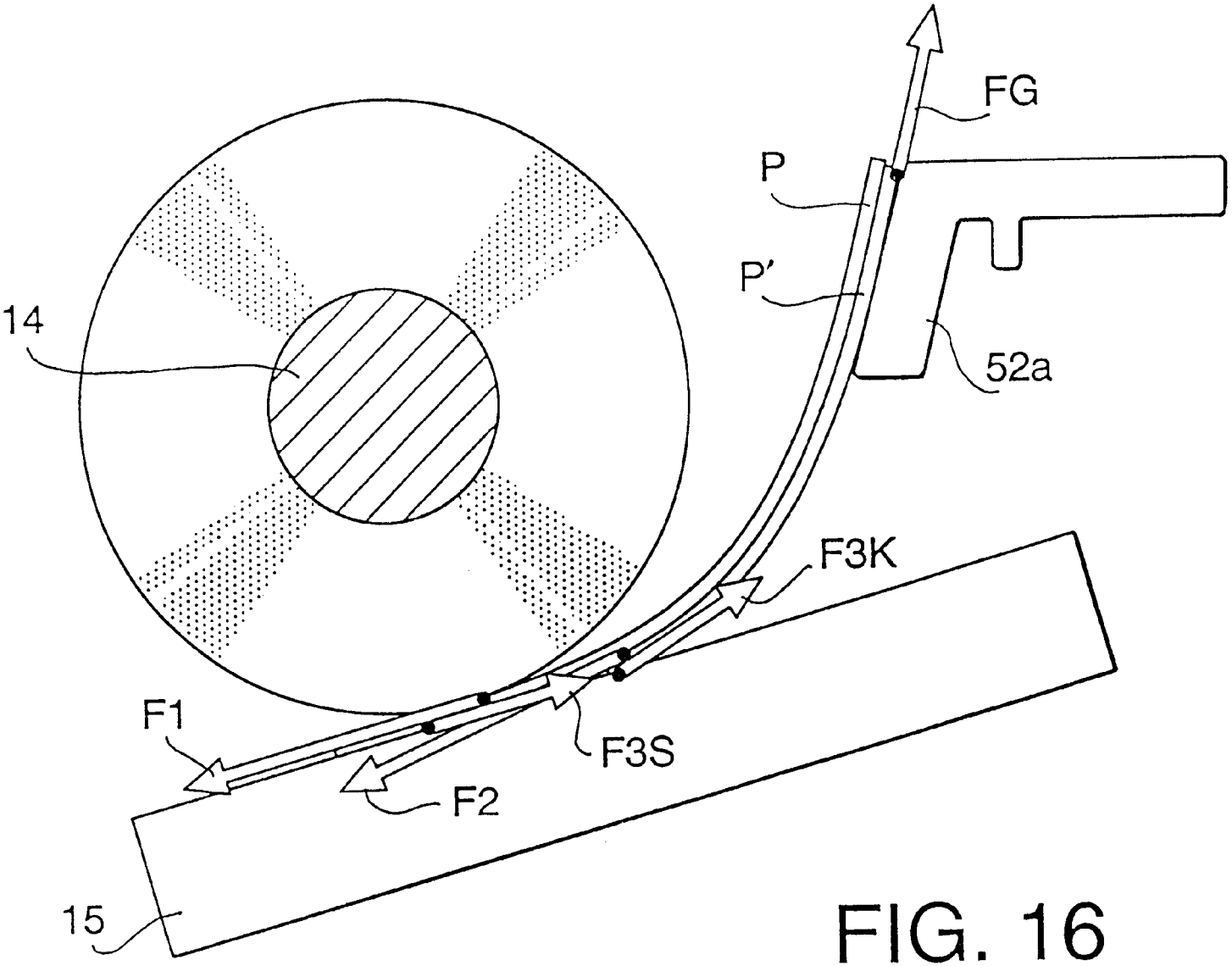
FIG. 16 is a side view of an arrangement of a platen roller and a thermal line head embodying the present invention, showing a paper separation function of the arrangement.

When conventional thermosensitive paper, known as thermal paper, is used, the ink cassette 30 is removed and the ink film ribbon R is not used. In this case, a plurality of sheets of thermal paper may be inserted into the printer at one time. FIG. 16 shows a design to separate sheets without a specific separating member when a plurality of sheets is inserted into the printer at one time.

As shown in FIG. 16, when first and second stacked sheets P, P' are supplied between the platen roller 14 and thermal line head 15, it is possible to separate the first and second sheets of paper if $$F_1 > F_3' > F_2 \quad (1), \text{ and}$$

$$F_{3K} > F_2 > F_{3S} + F_G \quad (2)$$

are satisfied when it is assumed that $$F_{3S} + F_{3K} + F_G = F_3', \text{ where:}$$

$F_1$ is a force in the feeding direction, given to the first sheet of paper P by the platen roller, $F_2$ is a force in the feeding direction, given to the second sheet of paper P' by friction with the first sheet of paper P, $F_{3S}$ is a force in the direction opposite to the feeding direction, acting between the first sheet of paper P and the thermal line head 15, $F_{3K}$ is a wedge effect force in the direction opposite to the feeding direction, acting between the second sheet of paper P' and the thermal line head 15, to prevent the second sheet of paper from entering into the platen/head interface, $F_G$ is a force in the direction opposite to the feeding direction, acting between the second sheet of paper P' and the housing 50, and $F_3'$ is a total resistance force acting on the second sheet of paper 20 in the direction opposite to the feeding direction.

The conditional inequality (1) is a condition to securely separate double fed sheets of paper. The conditional inequality (2) is a condition to transfer the paper to the position where the condition (1) can be securely satisfied. Taking the characteristics of the paper P and the thermal line head 15 into account, the material, hardness, diameter, etc., of the platen roller 14 are selected so as to satisfy conditions (1) and (2). Therefore, even though subsequent sheets of paper may be stacked after the second sheet of paper, the second sheet is stopped because of condition (1). Therefore no transfer force is given to any paper coming after the second sheet, when the first sheet is fed.

The present disclosure relates to a subject matter contained in Japanese Patent Applications No. HEI 5-236461, filed on Sep. 22, 1993, No. HEI 5-350354, filed on Dec. 29, 1993, and No. HEI 6-123813, filed on Jun. 6, 1994, which are expressly incorporated by reference herein in their entireties.

What is claimed is:

1. An ink film ribbon cassette, comprising:

a cassette casing for holding an ink film ribbon;

a winding core rotatably mounted in said cassette casing, wherein said ink film ribbon is wound on said winding core;

a paper entry slot in said cassette casing for introducing paper into said cassette casing;

a system that layers said ink film ribbon and said paper introduced into said cassette casing, said layering system comprises a plate spring and a layering roller; and a discharge outlet for discharging said ink film ribbon and said paper introduced into said cassette casing.

2. The ink film ribbon cassette according to claim 1, further comprising:

means for inducing back-tension on said ink film ribbon.

3. The ink film ribbon cassette according to claim 1, further comprising:

means for preventing slackening of said ink film ribbon, said slackening preventing means being disposed in said cassette casing.

4. The ink film ribbon cassette according to claim 1, said discharge outlet discharging ink film ribbon and unprinted paper from said cassette casing.

5. A method of printing information onto paper, comprising:

feeding a one-sided ink film ribbon from a roll towards and past a printing transfer channel;

layering said one-sided ink film ribbon and a sheet of paper such that said paper is fed in the same direction as said one-sided ink film ribbon, wherein said ink film ribbon is substantially as wide as said paper, said layering being performed by a spring plate and a roller;

advancing the layered one-sided ink film ribbon and the sheet of paper to a print location;

transferring printing information corresponding to one full line of a printed page to said layered one-sided ink film ribbon and paper at the print location; and separating said layered ink film ribbon and said paper from each other.

6. The method of printing information onto paper according to claim 5, a printhead and another roller being provided at the print location for transferring of printing information.

7. The method of printing information onto paper according to claim 5, further comprising positioning the spring plate and roller upstream with respect to the print location along a direction of feeder of the ink film ribbon.

8. An ink film ribbon cassette, said cassette comprising:

a cassette casing that receives an ink film ribbon;

a paper entry slot in said cassette casing, said paper entry slot receiving paper to be printed and inserting the paper into said cassette casing;

a system that positions said ink film ribbon and the paper inserted into said cassette casing into superimposed relation to each other, said positioning system comprising a plate spring and a roller; and a discharge opening that discharges said ink film ribbon and the paper.

9. The ink film ribbon cassette according to claim 8, further comprising a system that induces a back-tension on said ink film ribbon.

10. The ink film ribbon cassette according to claim 8, further comprising a system that prevents slackening of said ink film ribbon, said slackening preventing system being disposed within said cassette casing.

11. The ink film ribbon cassette according to claim 8, said discharge opening discharges said ink film and unprinted paper.

12. A method of printing information onto a record medium, comprising:

feeding an ink film ribbon towards and past a printing transfer channel;

positioning the ink film ribbon and a record medium in superimposed relation to each other between a roller and a biasing element, the record medium being fed in a same direction as the feeding of the ink film ribbon, the ink film ribbon being substantially as wide as the record medium;

advancing the ink film ribbon and the record medium from between the roller and the biasing element;

transferring printing information for the record medium to the superimposed ink film ribbon and record medium; and separating the superimposed ink film ribbon and record medium from each other.

13. The method of printing information onto a record medium according to claim 12, further comprising inducing a back-tension onto the ink film ribbon.

14. The method of printing information onto a record medium according to claim 13, wherein the inducing of back-tension on the ink film ribbon comprising providing brushes in contact with opposite sides of the ink film ribbon.

15. The method of printing information onto a record medium according to claim 12, further comprising preventing slackening of the ink film ribbon.

16. The method of printing information onto a record medium according to claim 12, wherein feeding the ink film ribbon comprises feeding the ink film ribbon from a roll.

17. The method of printing information onto a record medium according to claim 12, positioning of the ink film ribbon and record medium occurring at a position distinct from a position of transferring printing information.

18. The method of printing information onto a record medium according to claim 12, printing information being transferred by a printhead and additional roller.

19. The method of printing information onto a record medium according to claim 12, wherein the positioning of the ink film ribbon and record medium between a roller and a biasing element occurs upstream, in a direction of film ribbon advance, with respect to the position of printing information transfer.

* * * * *